US011103400B2

(12) United States Patent
Brulotte et al.

(10) Patent No.: US 11,103,400 B2
(45) Date of Patent: Aug. 31, 2021

(54) CEILING LIFT TILT MANAGEMENT SYSTEM

(71) Applicant: ArjoHuntleigh Magog Inc., Magog (CA)

(72) Inventors: Denis-Alexandre Brulotte, Orford (CA); Martin Faucher, Magog (CA); Joel Bossé, Sherbrooke (CA)

(73) Assignee: ArjoHuntleigh Magog Inc., Quebec (CA)

( * ) Notice: Subject to any disclaimer, the term of this patent is extended or adjusted under 35 U.S.C. 154(b) by 277 days.

(21) Appl. No.: 15/527,517

(22) PCT Filed: Nov. 17, 2015

(86) PCT No.: PCT/CA2015/051200

§ 371 (c)(1),
(2) Date: May 17, 2017

(87) PCT Pub. No.: WO2016/077923

PCT Pub. Date: May 26, 2016

(65) Prior Publication Data

US 2017/0354559 A1 Dec. 14, 2017

Related U.S. Application Data

(60) Provisional application No. 62/080,843, filed on Nov. 17, 2014.

(51) Int. Cl.

| | |
|---|---|
| ***A61G 7/10*** | (2006.01) |
| ***A45F 3/22*** | (2006.01) |
| ***B65H 75/44*** | (2006.01) |

(52) U.S. Cl.

CPC ..... *A61G 7/1015* (2013.01); *A45F 3/22* (2013.01); *A61G 7/1042* (2013.01);
(Continued)

(58) Field of Classification Search

CPC .. A61G 7/1015; A61G 7/1042; A61G 7/1051; A61G 7/1061; A61G 7/1065;
(Continued)

(56) References Cited

U.S. PATENT DOCUMENTS 5,499,408 A * 3/1996 Nix ..... A61G 7/1015 5/83.1
5,784,730 A * 7/1998 Hunt ..... A61G 7/1015 5/83.1

(Continued)

FOREIGN PATENT DOCUMENTS

CA 2284855 A1 8/2000
EP 2727571 A2 5/2014

(Continued)

*Primary Examiner* — Nicholas F Polito
*Assistant Examiner* — Morgan J McClure
(74) *Attorney, Agent, or Firm* — The Webb Law Firm

(57) ABSTRACT

A ceiling lift tilt management system includes first and second motor units, which are attachable to a rail system of a medical care facility. Each motor unit includes a flexible strap, which can be coiled or uncoiled within the motor unit to raise or lower a spreader bar attached thereto. Coiling or uncoiling of the straps can cause raising or lowering of a sling attached to the spreader bars. The system also allows for tilting of the spreader bars by coiling or uncoiling a leading motor unit strap. The system includes a control system that measures the relative lengths of the two straps in order to ensure that relative tilt between the spreader bars does not exceed a threshold. Once a threshold tilt for height
(Continued)

difference is reached, further user requests for additional tilting are prohibited. Patient comfort and safety are therefore ensured.

20 Claims, 4 Drawing Sheets

(52) U.S. Cl.
CPC ..... *A61G 7/1051* (2013.01); *A61G 7/1061* (2013.01); *A61G 7/1065* (2013.01); *A61G 7/1069* (2013.01); *A61G 7/1073* (2013.01); *A61G 7/1078* (2013.01); *B65H 75/4484* (2013.01); *A61G 7/109* (2013.01); *A61G 7/1071* (2013.01); *A61G 2203/10* (2013.01); *A61G 2203/30* (2013.01); *A61G 2203/32* (2013.01); *A61G 2203/42* (2013.01)

(58) Field of Classification Search
CPC .. A61G 7/1069; A61G 7/1073; A61G 7/1078; A61G 7/1071; A61G 7/109; A61G 2203/10; A61G 2203/30; A61G 2203/32; A61G 2203/42; A45F 3/22; B65H 75/4484
See application file for complete search history.

(56) References Cited

U.S. PATENT DOCUMENTS

| | | | | |
|---|---|---|---|---|
| 6,523,195 | B1 | 2/2003 | Rodier et al. | |
| 7,690,056 | B2 * | 4/2010 | Moffa | A61G 7/1017 5/84.1 |
| 10,182,955 | B2 * | 1/2019 | Brulotte | A61G 7/1015 |
| 2005/0044629 | A1 | 3/2005 | Rouse et al. | |
| 2010/0270252 | A1 * | 10/2010 | Chepumy | A61G 7/1015 212/76 |
| 2011/0239367 | A1 * | 10/2011 | Gramkow | A61G 7/1015 5/83.1 |
| 2011/0289684 | A1 * | 12/2011 | Parish | A47C 21/044 5/421 |
| 2013/0019401 | A1 | 1/2013 | Faucher et al. | |
| 2014/0115778 | A1 | 5/2014 | Ng | |

FOREIGN PATENT DOCUMENTS

| | | | |
|---|---|---|---|
| EP | 2764857 | A2 | 8/2014 |
| WO | 2008029272 | A2 | 3/2008 |
| WO | 2010057492 | A1 | 5/2010 |
| WO | 2013011367 | A2 | 1/2013 |

* cited by examiner

CEILING LIFT TILT MANAGEMENT SYSTEM

CROSS REFERENCE TO RELATED APPLICATIONS

This application is the United States national phase of International Application No. PCT/CA2015/051200 filed Nov. 17, 2015, and claims priority to U.S Provisional Patente Application No. 62/080,843 filed Nov. 17, 2014, the disclosures of which are hereby incorporated in their entirety by reference.

TECHNICAL FIELD OF THE DISCLOSURE

The present disclosure relates to a ceiling lift tilt management system, which include embodiments to an apparatus and a method of managing tilt of a patient harness in a ceiling lift system.

BACKGROUND OF THE DISCLOSURE

Ceiling lifts for lifting and transporting patients have been in use for over twenty years. These types of patient lifts are becoming more popular as they take up little space in a hospital or care home environment and are more efficient than floor lifts.

A ceiling lift can be described as a motor unit able to move along one or more rails arranged as a rail system, fixed to the ceiling. A flexible member such as a strap extends from the motor unit and is attached to a spreader bar. A patient sling or harness is attached to the spreader bar. An electrically motorized mechanism in the motor unit allows the user to extend or shorten the strap so as to raise or lower the spreader bar and, with this, to raise or lower the sling and any patient carried in the sling. The combination of rail system, motor unit, spreader bar and sling is often referred to as a ceiling lift system.

Some ceiling lift systems are said to be fixed (the motor unit is dedicated to one room) while others are said to be portable (the motor unit can move around from room to room).

Over the last decades, the size (weight & morphology) of patients has increased, causing manufacturers of ceiling lift systems to develop solutions which better address the handling challenges that larger patients pose. The initial response from manufacturers was to increase the lifting capacity of their existing products. Since then, patient handling techniques were developed, industry standards were established, and user (patient and care givers) needs were better understood. It appears that there was room for devices which could do more than just having a greater lifting capacity and be able to transfer a patient in a fixed seated position. Indeed, users were in the need of a product with greater versatility.

One design adopted by manufacturers for handling patients of very large size (with a Body Mass Index above 40 or of weight above 160 kg, for example) has two motor units with two spreader bars which operate together. In one configuration, one of the motor units and its associated spreader bar supports/lifts the shoulder section of the patient, while the other motor unit and spreader bar supports/lifts the patient's leg section. A key benefit of such solution is the ability to provide a tilting function to sit or recline the patient during transfer, by creating a height difference between the spreader bars. Bringing the leg section spreader bar above the shoulder section spreader bar leads to a patient reclined position, while bringing the leg section spreader bar below the shoulder section spreader bar leads to a patient sitting position.

The tilting function increases patient comfort and reduces caregiver effort required to transfer a patient. Although this functionality can significantly improve patient comfort, it can lead, particularly for very large patients, to uncomfortable or hazardous situations.

SUMMARY OF THE DISCLOSURE

The present disclosure seeks to provide an improved ceiling lift management system.

According to an aspect of the present disclosure, there is provided a patient ceiling lift system including: first and second motor units; first and second flexible strap elements each coupled to a respective one of the first and second motor units, each motor unit being operable to change an operative length of its associated strap element by extending or retracting the strap out of or into the motor unit, each strap element including a coupling for attachment to a patient sling; first and second position sensors, each coupled to provide an indication of the operative length of a respective one of the strap elements; an input unit configured to command operation of the motor units to change the operative lengths of the first and second strap elements; a control unit configured to determine a difference between the operative lengths of the first and second strap elements and to control the first and second motor units to prevent any further increase in the difference if the difference reaches or exceeds a threshold difference.

According to another aspect of the disclosure, there is provided a patient ceiling lift system including: first and second tensile support members operatively associated with a winding assembly to adjust an operative length of the tensile support members by extending or retracting the tensile support member, each tensile support member including a coupling for attachment to a patient sling; first and second position sensors, each configured to provide an indication of the operative length of a respective one of the tensile support members; and a controller configured to determine a difference between the operative lengths of the first and second tensile support members and to prevent any further increase in the difference if the difference reaches or exceeds a threshold difference.

According to another aspect of the disclosure, there is provided a patient ceiling lift system including: first and second tensile support members operatively associated with a winding assembly to adjust an operative length of the tensile support members by extending or retracting the tensile support member; sling support apparatuses attachable to each of the tensile support members, wherein the sling support apparatus includes a coupler for securing a sling; first and second sensors configured to provide an indication of the relative height of the sling support apparatuses with respect to one another; and a controller configured to determine and regulate a relative difference in height of the two sling support apparatuses.

The structure of an embodiment of this system allows a patient to be tilted when supported by the lift but in a manner in which the degree or angle of tilt is controlled and specifically limited. Once the threshold has been reached, no further tilting is allowed irrespective of any input command from an operator seeking to increase patient tilt.

The motor units may be separate devices with separate casings and components, linked electrically for coordinated control, as well as being individually controllable. It is not excluded, though, that the motor units could be incorporated into a common device with a common casing. In such cases, the motors of each motor unit remain both independently controllable and controllable in coordinated manner. The link between the motor units may be a direct link or an indirect link, for instance through a controller.

Advantageously, the sensors may be coupled to respective motor units. In an embodiment, one of the first and second motor units is a master unit and the other is a slave unit. The input unit advantageously includes an input tilt command providing for a change in the operative lengths of the first and second strap elements relative to one another and thereby for a change in tilt, wherein the master unit adjusts the operative length of its associated strap element to produce the tilt. In an example embodiment, the slave unit does not change the operative length of its associated strap element during a tilt command. Thus, all control of tilt is carried out through a single one of the motor units.

In an illustrative embodiment, the control unit prevents any further change in the operative lengths of the first and second strap elements in response to a tilt command requesting increase in tilt when the threshold difference is met or exceeded. The control unit may allow for a change in the operative lengths of the strap elements in a direction that reduces tilt.

In an example embodiment, the input unit is connected directly to the master unit. The master unit is connected electrically to the slave unit.

In an example embodiment, the master unit is a patient leg support unit and the slave unit is a patient head support unit. Thus, tilt is achieved by moving the patient's legs and not the patient's head.

Advantageously, the control unit permits only a change in the operative lengths of the strap elements, which reduces the difference in operative lengths of the strap elements. In an example embodiment, the control system allows synchronised up and down motion of the straps when the threshold difference has been reached, in some embodiments even when this has been exceeded. The first and second position sensors may measure motor position. The first and second motor units advantageously include a drum around which the associated strap element can be wound, wherein the first and second motor units are rotary motors, and wherein the first and second position sensors are coupled to measure rotation of the associated rotary motor.

A differential change in the operative lengths of the first and second strap elements advantageously provides for moving a patient from a reclining to a sitting position. A differential change in the operative lengths of the first and second strap elements is, in an example embodiment, effected by a single one of the first and second motor units.

The system may include at least one limit switch associated with one of the first and second strap elements, wherein the limit switch determines a limit length of the associated strap element. The limit switch may determine a minimum operative length of the associated strap element.

A limit switch may be associated with each of the first and second strap elements. In an embodiment, the control unit is coupled to the limit switch and is operative to determine a calibration position of the associated strap element.

In an embodiment, a ceiling lift tilt management system is provided that includes first and second motor units, which are attachable to a rail system of a medical care facility. Each motor unit includes a flexible strap, which can be coiled or uncoiled within the motor unit, to raise or lower a spreader bar attached thereto. Coiling or uncoiling of the straps can cause raising or lowering of a sling attached to the spreader bars. The system also allows for tilting of the spreader bars by coiling or uncoiling a leading motor unit strap. The system includes a control system, which measures the relative lengths of the two straps in order to ensure that relative tilt between the spreader bars does not exceed a threshold. Once a threshold tilt for height difference is reached, further user requests for additional tilting are prohibited. Patient comfort and safety are therefore ensured.

Other features and aspects of the disclosure herein will become apparent from the detailed disclosure that follows.

BRIEF DESCRIPTION OF THE DRAWINGS

Embodiments of the present disclosure are described below, by way of example only, with reference to the accompanying drawings, in which.

DESCRIPTION OF THE ILLUSTRATIVE EMBODIMENTS

Figure 1:
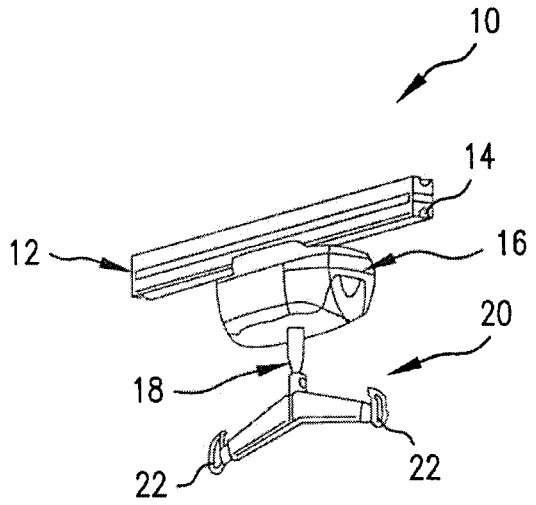
FIGS. 1 and 2 show an example of a prior art ceiling lift system, spreader bar and sling.

Referring first to FIG. 1, this shows a conventional ceiling lift system 10 which includes a rail 12 that is fixed to the ceiling structure of a patient care facility, such as a hospital, care home or the like. The rail 12 includes a downwardly depending channel 14. The system 10 may include a transmission, winding or coiling assembly, having for example a motor unit 16 which includes a wheel or roller (not shown) which runs within the downwardly depending channel 14 to allow the motor unit 16 to be moved in supported manner along the rail 12, as is known in the art.

Figure 2:
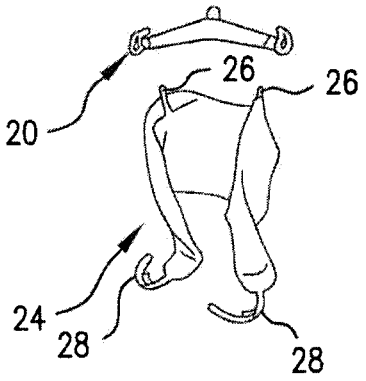

The motor unit 16 is operatively associated with, coupled to and/or includes a tensile support member, such as a flexible element or strap 18, which in practice is attached to a motorised spool or drum within the motor unit 16, and which can be unwound from the spool to lengthen the strap 18 and wound on the spool to shorten the strap 18, again in known manner. One skilled in the art would appreciate that one or more or any number of tensile support members may be operatively associated with, coupled to and/or form part of a motor unit to facilitate patient support. In one embodiment, the tensile support member is configured to be coilable about the drum or motorized spool of motor unit 16 and having sufficient tensile strength for lifting a patient. In an exemplary embodiment, the support member may be rigid in tension along its length yet permit motion in other directions to dynamically support a patient, inclusive of bariatric patients. Exemplary support members may include webbing, belts, rope, wire, cord, cable and chains. The strap 18 includes a coupler at its lower, free end, to which there can be attached a sling support apparatus or spreader bar 20, again of known form. The coupling can be any fastener, connector, attachment or securement mechanism suitable for connection to sling support apparatus or spreader bar 20. In one embodiment, the spreader bar 20 may include coupling points 22, which are spaced from one another and specifically at either end of the bar 20. The coupling points 22 act as attachments for a sling 24, as shown in FIG. 2. The coupling points 22 may be any coupler, fastener, hook, catch, attachment or securement mechanism suitable for securing a sling to the sling support apparatus or spreader bar 20. The sling 24 is provided with a plurality of straps 26, 28, which attach to the coupling points 22 so that the sling 24 is held by the spreader bar 20 in an open condition to support a patient comfortably in the sling 24. These slings are well known in the art.

Figure 3:
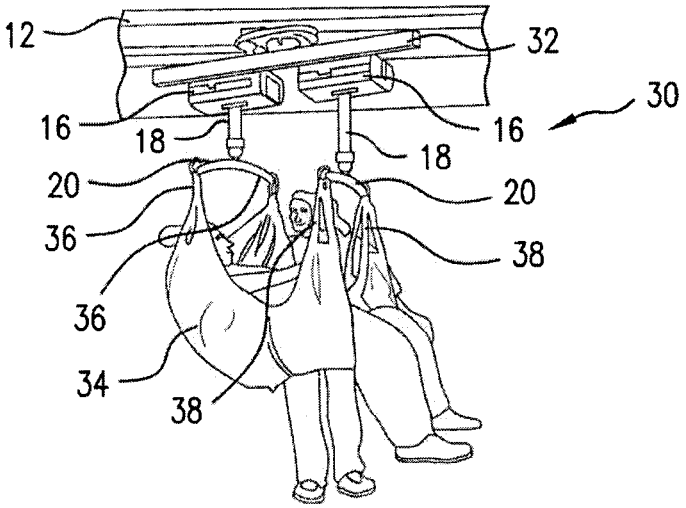
FIG. 3 shows an example of a double motor ceiling lift system of this disclosure.

While a system as shown in FIGS. 1 and 2 is suitable for lifting and transporting patients up to moderate sizes, heavier or larger patients cannot be carried by a simple system of this nature. In this regard, the apparatus of FIG. 3 is generally used. The apparatus 30 includes two motor units 16 that are attached to a support unit 32, is coupled to the rail 12, as in the example of FIG. 1. The apparatus 30 includes two spreader bars 20, each attached to a respective strap 18 of a respective motor unit 16. The motor units 16 are spaced from one another so that one strap 18 and its associated spreader bar 20 can be located around the top of the patient's torso, whereas the other motor unit and spreader bar 20 is located around the patient's thigh position. A sling 34 includes pairs of straps 36, 38 coupling to respective spreader bars 20, which allow a patient to be held within the sling 34 in a gently reclining position as shown in the example of FIG. 3.

The motor units 16 are operable to release and withdraw lengths of strap 18 such that the spreader bars 20 can be raised or lowered as required. For instance, the straps 18 can be lengthened to lower the spreader bars 20 towards a patient reclining on a bed and then wound into the motor units 16 to raise the spreader bars 20 and thus to raise the patient while carried in the sling 34. The motor units 16 are, for this purpose, controlled by a caregiver such as nurse, and are advantageously movable independently of one another so that the patient can be moved to different positions while suspended in the sling 34. For example, the patient can be held in a substantially reclining position as shown in FIG. 3 or could be raised to a sitting position, by raising the spreader bar 20 at the torso end of the patient.

Figure 4:
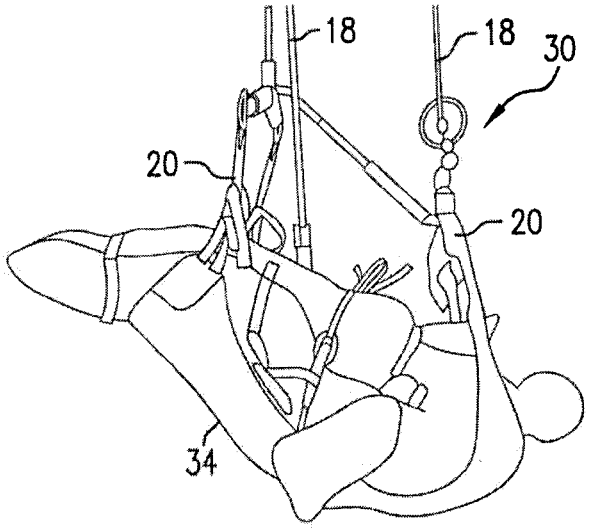
FIGS. 4 and 5 show examples of extreme positions of a double motor ceiling lift system.
Figure 5:
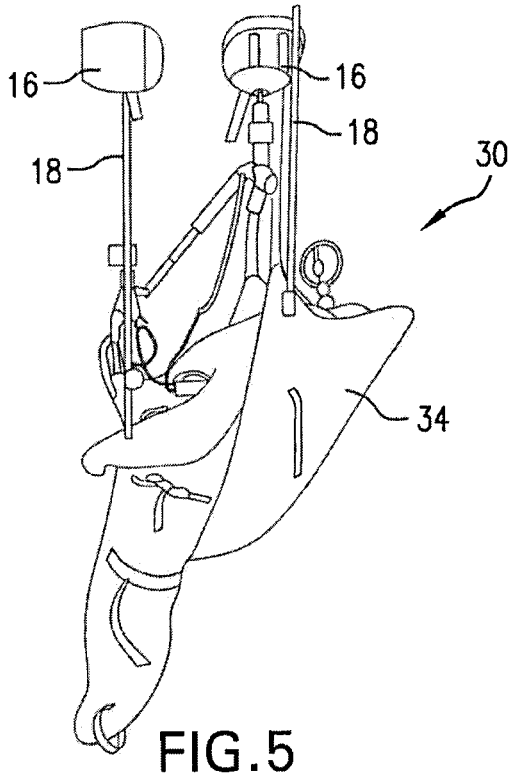

A problem can arise, however, particularly with very large or heavy patients, in the control of the apparatus 30. Two examples are shown in FIGS. 4 and 5. In FIG. 4, the spreader bar at the patient's torso side has been lowered whereas the spreader bar 20 at the thigh side has been raised, by appropriate lengthening or shortening of the straps 18 by appropriate actuation of the associated motor unit 16. As can be seen in FIG. 4, the patient's shoulders and head are significantly lower than the patient's legs in the configuration shown, which can lead to patient discomfort. In FIG. 5, on the other hand, the apparatus 30 has been operated such that the patient's shoulders and head are much higher than the patient's legs and so much so that the patient has slid out from the sling 34, which poses an evident danger to the wellbeing of the patient. Specifically, a position in which the patient is reclined too far (with the patient's legs above their shoulders) can put unnecessary pressure on the patient's torso and respiratory organs, particularly very large patients where pressure is applied by fat located in the abdomen area. If the patient's legs are raised much higher than the patient's shoulders, it is possible also for the patient to slide out of the sling head first. When a patient is placed in too high a seated position, as depicted in FIG. 5, significant pressure from the sling can be applied to the patient's thighs, causing the patient to be supported by only a small surface area of the sling, causing high sheer skin pressure. Particularly large patients typically have very sensitive skin from the stretching the skin endures.

The teachings herein provide a system which is able to avoid the problems identified above. The non-limiting example embodiment described below uses a plurality of motor units, two motor units in the example shown, each having an associated spreader bar, in which the spreader bars are operated at least in part together in order to control the height difference between the spreader bars. The non-limiting example embodiment stops a tilting function of the apparatus when a set limit is reached, irrespective of further input command seeking to increase patient tilt. In the non-limiting example embodiment, the system sets a maximum height difference between the two spreader bars at plus or minus 350 mm. In a practical embodiment, tilting is effected by keeping one spreader bar still (preferably at the shoulder or head side of the patient), while moving the other spreader bar upwardly or downwardly to achieve patient tilt, with a height difference of the moving spreader bar set to a maximum of 350 mm relative to the shoulder spreader bar. This arrangement, as described below, provides a controllable and reliable mechanism to alter the configuration of a patient supported in the sling in a manner that can avoid any chance of the patient being put into a too uncomfortable or potentially dangerous position. This exemplary maximum difference in the height between the spreader bars has been found to be the most appropriate, although a height difference limit may be plus or minus 25 mm either side of this exemplary limit. In other words, a height limit in a range of 325 mm to 375 mm has been found to be suitable.

Figure 6:
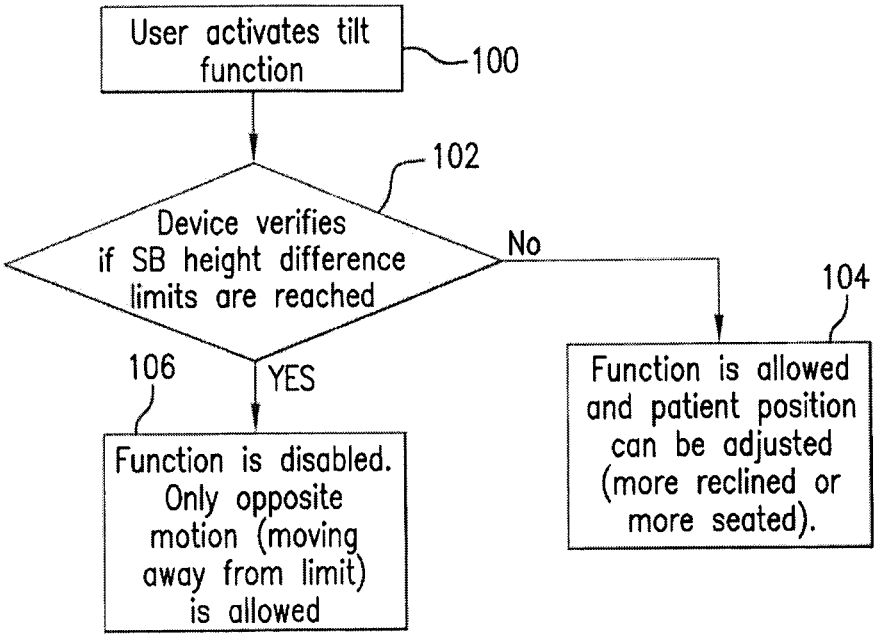
FIG. 6 is a flow chart depicting the functionality of an embodiment of dual motor ceiling lift system.

Referring now to FIG. 6, this shows in conceptual form, in the format of a functional flow chart, how example embodiments of the system operate. At step 100, the user, typically a care giver, will activate a tilt function, once a patient is supported within a sling 34. The system verifies, at step 102, whether the height difference between the two spreader bars has reached a predetermined limit or not. When the system determines that the height difference limit has not been reached, the patient's position can be adjusted, for instance in a more reclined or more seated position under operator command, at step 104.

On the other hand, if at step 102 it is determined that the height difference limit has been reached, the tilting function of the system is disabled, allowing only motion in the opposition direction, that is away from the height difference limit. Thus, a patient cannot be reclined or seated more than the defined limit, but can be moved back in the opposite direction. This functionality of step 106 overrides any activating input provided by the user at step 100, thereby blocking further adjustment of the system parameters in a manner that is deemed undesirable beforehand.

Figure 7:
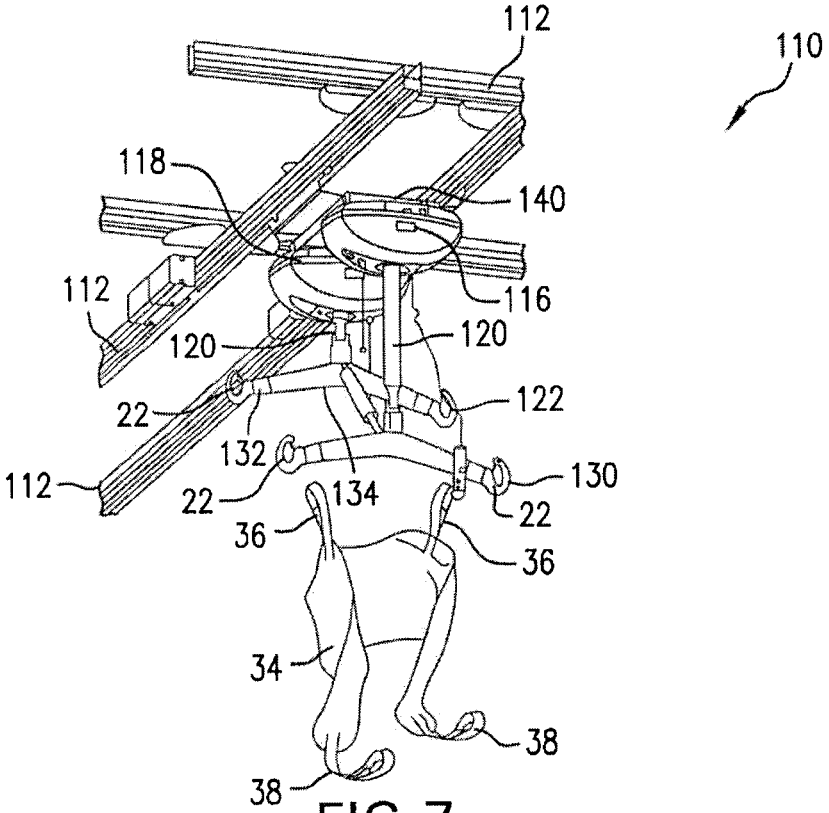
FIG. 7 shows an embodiment of dual motor ceiling system incorporating the functionality depicted in FIG. 6.

As explained above, the tilt function is effected by keeping one of the spreader bars fixed while moving the other. Referring now to FIG. 7, there is shown an embodiment of the apparatus 110.

The apparatus 110 is designed to be supported on, and be movable along, a rail system 112 similar to that of the embodiment of FIG. 1. The assembly 110 of FIG. 7 includes a leading or master motor unit 116 and a driven or slave motor unit 118, which in basic form are similar to the motor units 16 of the examples of FIGS. 1 to 5. Thus, the motor units 116, 118 include straps 120 that can be lengthened or shortened in order to lower or raise a spreader bar 22 attached to the ends of the straps 120. The apparatus 110 includes a thigh position spreader bar 130 and a shoulder or head spreader bar 132, connected respectively to an associated motor unit 116, 118. The spreader bars 130, 132 can be exactly the same as one another, with their designation being dependent solely upon the motor unit 116, 118 to which they are coupled. In this example, the two spreader bars 130, 132 are coupled together by a coupling element 134 so that they act as a unitary component, although this is not necessary.

The spreader bars 130, 132 include coupling points 22, which can be connected to respective straps 36, 38 of a sling 34, similar to the arrangement shown in FIG. 3. The motor units 116, 118 are coupled to a trolley 140, which includes the rollers or wheels which couple to the railing 112, enabling the assembly 110 to slide along the railing system 112 in known manner.

The apparatus 110 also includes a controller or control system, which can be incorporated within one of the motor units 116, 118, or which can equally be housed in a separate unit or casing operatively associated with the apparatus 10 and connected to the motor units 116, 118 by suitable electrical connectors. Suitable electrical connectors may be embodied as wires, a wireless communication system, or combinations thereof. The controller or control system may include, be connected to or otherwise may be operatively associated with one or more sensors for detecting the position and/or relative position of various components of apparatus 110, including without limitation sling support apparatuses 20, coupling points 22, tensile support members 18 and/or any portions thereof. In one embodiment, the controller or control system may be operatively associated with first and second sensors configured to provide an indication of the relative height or distances of the sling support apparatuses from respective motor units 116, 118 with respect to one another. The controller may be configured to determine and regulate the relative difference in distance or height of the two sling support apparatuses with respect to one another. In one embodiment, this relative distance or height may be determined by assessing the length of tensile support members 18. In another embodiment, optical sensors or other detection mechanism may be used to assess the relative difference in height or distance of the two sling support apparatuses. In one embodiment, the sensors detect the relative distance or height of one or more respective couplers 22 or midpoints of the two sling support apparatuses 20.

Figure 8:
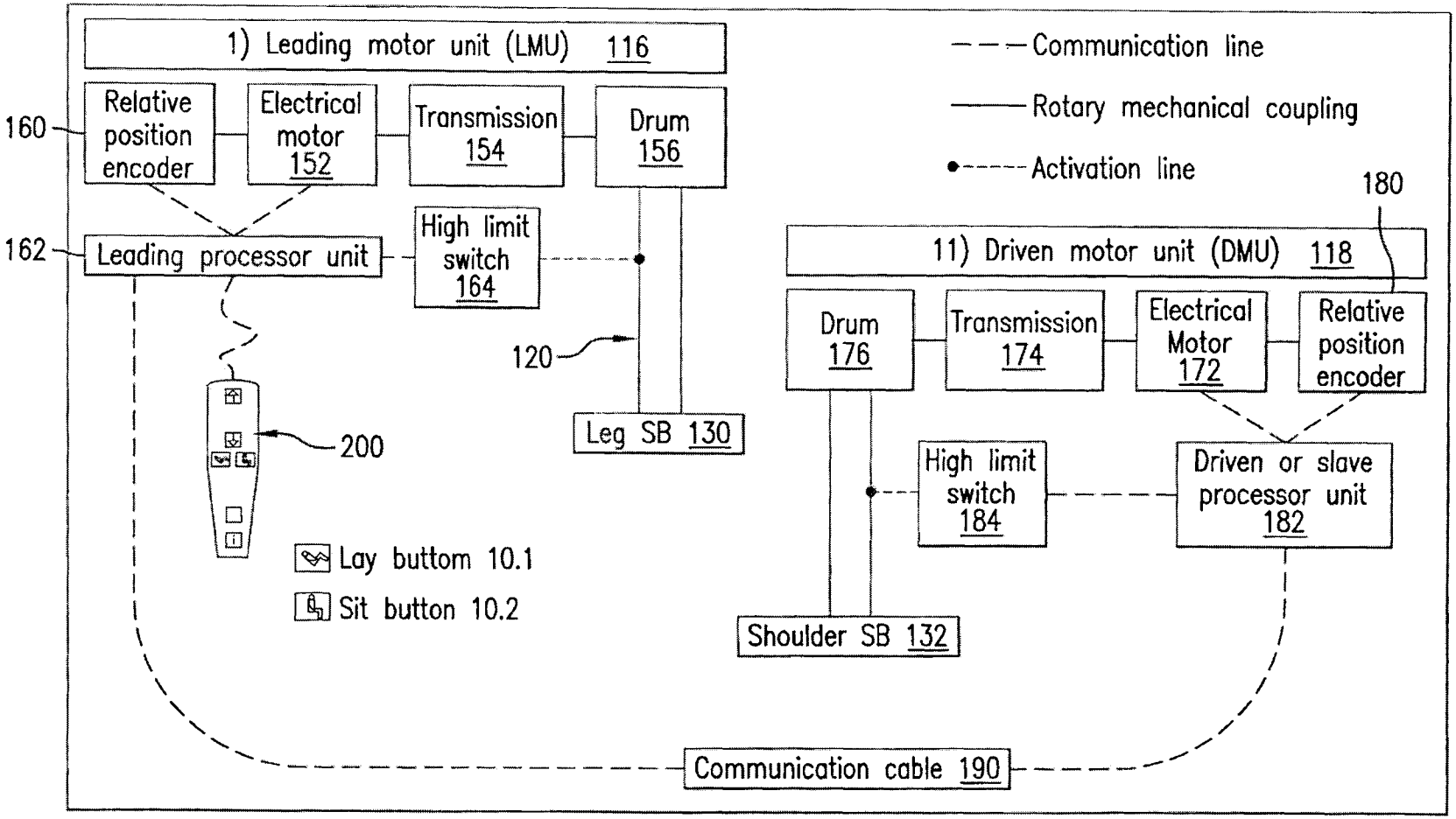
FIG. 8 is a schematic diagram showing principal components of an illustrative, non-limiting embodiment of a ceiling lift system.

An example embodiment of the controller or control system 150 for controlling the dual motor assembly 110 is shown in FIG. 8. The control system 150 includes two primary sections, one associated with the leading or master motor unit 116 and the other associated with the driven or slave motor unit 118. The leading motor unit 116 includes an electrical motor 152 having an output coupled to a transmission 154, itself linked to a spool or drum 156. The strap 120 is attached to and wound on the drum 156 and its end is connected to the leg spreader bar 130.

The leading motor unit 116 also includes a sensor, such as a relative positioning encoder 160 for detecting or measuring the relative position of the electrical motor 152, although it could, in other embodiments, be coupled to detect or measure rotation of the drum 156. A leading processor unit 162 is coupled to the relative positioning encoder 160 and the electrical motor 152. A height limit switch 164 is coupled to the leading processor unit 162 and to the strap 120, for purposes described below.

The structure of the driven motor unit 118 is similar and includes an electrical motor 172, a transmission unit 174 and a drum or spool 176 to which the strap 120 is attached and wound. The strap 120 is, in practice, attached to the shoulder spreader bar 132 as previously described.

The driven motor unit 118 includes a relative positioning encoder 180 coupled to the electrical motor 172 (or alternatively to the drum 176) for obtaining a measure of the position of the electrical motor 172 (or alternatively to the drum 176) and, as a result of, the length of the strap 120.

The driven motor unit 118 also includes a driven or slave processor unit 182, which is connected to the electrical motor 172 and another sensor, such as a relative positioning encoder 180. There is also provided additional sensors, such as a high limit switch 184, which is coupled to the driven processor unit 182, and operates with a feature of the strap 120, described in further detail below.

The control system 150 also includes a communications link between the leading and driven processor units 162, 182, this being a communications cable 190, although other embodiments could use an optical or wireless link, for example.

An input device 200 for user interface, which in this embodiment is a wired hand-held control unit, is coupled to the leading processor unit 152 and provides a variety of functions, such as raising and lowering the spreader bars to raise or lower the sling and, therefore, the patient, as well as tilt functions, which in this example embodiment are to a reclining position and to a sitting position. The tilt controls are operated by a user, such as a caregiver, via the user interface control unit and are intended allow the caregiver to choose the relative positions of the spreader bars 130, 132 in order to determine the degree of tilt of a patient held within the sling 34.

The operation of the example embodiment is as follows. The relative positioning coders 160, 180 monitor the rotational displacement (with direction of rotation) on their respective electrical motors 152, 172 and, as a result, the rotational displacement of their associated drums 156, 176. This is achieved in this embodiment since the encoders 160, 180 are mechanically linked to the respective drums 156, 176 through the associated transmissions 154, 174. It will be appreciated that in other embodiments, the relative position encoders 160, 180 could be connected directly to the drums 156, 176, or replaced by any other device able to determine the extended length of their associated straps 120.

Rotational motion of the drums 156, 176 resulting from operation of their associated electrical motor 152, 172 causes the straps 120 to be coiled or uncoiled on the drums depending upon the direction of rotation. This coiling or uncoiling of the straps 120 causes the vertical motion of the associated spreader bars 130, 132. The processor units 162, 182 are able to translate the output of the rotational encoders 160, 180 into rotational movement of the associated drums 156, 176.

The driven or slave processor unit 182 is programmed to feed back at regular intervals to the master processing unit 162, via the communications link 190, the value of its rotational displacement encoder 180 or an indicative value of this or of the extension of the associated strap 120. It is advantageous that the feedback signal is sent every 50 milliseconds during operation of the apparatus.

The leading processor unit 162 will compare at each interval the value provided by the driven processor unit 182 and the relative position indicated by its own encoder 160, or the equivalent measure thereof, and to determine a difference between these two values. That difference is then compared to the maximum difference set within the control system and representative of a maximum height difference between the two spreader bars 130, 132. If the result is at or greater the maximum allowed difference (as in an example embodiment to be about 350 millimetres or in a range between about 325 mm and 375 mm), the leading processor unit 162 disables further actuation of the electrical motor 152 in the same direction of tilt, thereby limiting the degree or angle of tilt between the two spreader bars 130, 132. As the result of this any further actuation by the caregiver of the input unit 200 in the direction of further tilt will be ineffective. The only change in tilt allowed at this point is in the reverse direction, thereby to reduce the tilt between the two spreader bars 130, 132 and as a result of the sling 34.

In practice, a program or algorithm in the leading motor unit processor 162 provides this functionality. The skilled person will readily appreciate the components and functionality of the processor units 162, 182.

It will be appreciated that when it is commanded to raise or lower the sling, the leading and driven motor units 116, 118 will both operate to coil or uncoil their respective straps 120, although the relative positions of the two straps (determined by the relative position encoders) continues to be monitored. When it is desired to change the relative height between the two spreader bars 130, 132, that is the tilt between them and the tilt of the patient, it is the leading motor unit 116 which is activated, leaving the driven motor unit dormant, such that only a single one of the motor units is operated. It will be appreciated that other embodiments may control the other motor unit, or both, to achieve tilt but this is not preferred.

The straps 120 include a feature fixed at appropriate positions on the straps 120, which act as a sensing element for the height limit switches 164, 184, and are used to identify when the associated strap 120 has been wound to a predetermined limit. The feature could, for example, be an optical reflector, a metallic or magnetic element, or optical feature detectable by the height limit switch, which will be an associated sensor. In one embodiment, the sensor is configured as height limit switches 164, 184 that allow the processor units 162, 182 to reset to zero the drum rotational displacement counter and, thereby, to be able to calibrate the extended lengths of the straps 120 and, as a result, the positions of the spreader bars 130, 132. There may also be provided a lead sensor useful in detecting cases where a spreader bar is lifted when it does not carry any load. In an alternative, the system could measure motor amperage and compare this to a threshold equivalent to a load of 12 kilograms.

It will be appreciated that sensing on zero load can be achieved also by other sensors coupled directly to the electrical motors. The provision of a load sensor is useful in checking whether a patient is properly carried by a sling 34 and that the sling 34 is properly attached to the lifting apparatus.

The height limit switches 164, 184 are triggered at initial start-up of the apparatus and during usage, particularly, when the product has been stored. The user operates the device by pressing an appropriate control on the input unit 200.

Pressing the down arrow or up arrow keys of input unit 200 will cause simultaneous down or up motion of both spreader bars, as the result having no impact on the relative displacements indicated by the two relative positioning encoders 160, 180 (ignoring, as will be appreciated, any offset in ascending and descending motion speeds). This will result in a raising or lowering of the patient. Pressing the sit button 10.2 on the control unit on the input unit 200 will cause the legs spreader bar 130 to be lowered and thus increasing the rotational displacement counter from the relative positioning encoder 160. This will translate in gradual patient tilt towards a more seated position. On the other hand, pressing the laying button 10.1 of the input unit 200 will cause the legs spreader bar 132 only to rise, hence reducing the rotational displacement count in the relative positioning encoder 160. This will translate into gradual patient tilt motion towards a more reclined position. When the difference between the encoder counts 160, 180 reaches the allowable difference, further movement in the same direction becomes prohibited and only movement in the opposite direction is allowed.

The skilled person will appreciate that the motor position detectors could be replaced or supplemented by a sensor arranged to measure directly the operative length of a strap. This would typically be coupled directly to the strap.

The motor units 116, 118 may be separate devices with separate casings and components, linked electrically for coordinated control, as well as being individually controllable. It is not excluded, though, that the motor units 116, 118 could be incorporated into a common device with a common casing. In such cases, the motors of each motor unit remain both independently controllable and controllable in coordinated manner. The link between the motor units may be a direct link or an indirect link, for instance, through a controller.

In example embodiments, at least one of the straps 120 will be provided with an identification marker, which can be matched to a marker of a patient sling to ensure that the patient sling is correctly attached to the apparatus 110. This could, in one example, be by a colour coding.

In some instances the sling may have adjustable straps, which enables adjustment both by the sling straps and, subsequently, by the apparatus 110.

All optional and preferred features and modifications of the described embodiments and dependent claims are usable in all aspects of the disclosure taught herein. Furthermore, the individual features of the illustrative embodiments, as well as all optional and preferred features and modifications of the described embodiments, are combinable and interchangeable with one another.

The disclosure in the abstract accompanying this application is incorporated herein by reference.

While systems, apparatuses and methods have been described with reference to certain embodiments within this disclosure, one of ordinary skill in the art will recognize, that additions, deletions, substitutions and improvements can be made while remaining within the scope and spirit of the invention as defined by the appended claims.

We claim:

1. A patient ceiling lift system comprising:

first and second tensile support members operatively associated with a winding assembly to adjust an operative length of the first and second tensile support members by extending or retracting the first and second tensile support members, each tensile support member including a coupling for attachment to a patient sling;

first and second position sensors, each configured to provide an indication of the operative length of a respective one of the first and second tensile support members; and a controller configured to determine a difference between the operative lengths of the first and second tensile support members and to prevent any further increase in the difference if the difference reaches or exceeds a threshold difference, wherein the winding assembly comprises a first motor unit coupled to the first tensile support member and a second motor unit coupled to the second tensile support member, each of the first motor unit and the second motor unit being moveable along a rail, wherein the first and second position sensors are coupled to a respective one of the first and second motor units, wherein one of the first and the second motor units is a master unit and the other is a slave unit, and wherein the master unit controls a patient leg support and the slave unit controls a patient head support, such that tilt is achieved by moving the patient's legs and not the patient's head.

2. The system according to claim 1, wherein at least one of the first and second tensile support members is substantially rigid when placed in tension along its length and movable in other directions to dynamically support a patient.

3. The system according to claim 1, wherein at least one of the first and second tensile support members comprises a strap, webbing, belt, rope, wire, cord, cable and/or chain.

4. The system according to claim 1, further comprising a user interface control unit configured to command operation of the winding assembly to change the operative lengths of the first and second tensile support members.

5. The system according to claim 1, wherein the first and second position sensors measure motor position.

6. The system according to claim 5, wherein the user interface controller unit is connected to the master unit and includes an input tilt command providing for a change in the operative lengths of the first and second tensile support members relative to one another, allowing for a change in tilt of the patient sling supporting a patient, wherein the master unit adjusts the operative length of its associated tensile support member to produce said tilt, and the slave unit does not change the operative length of its associated tensile support member during a tilt command.

7. The system according to claim 5, wherein the master unit is connected electrically to the slave unit.

8. The system according to claim 5, wherein the master unit is a patient leg support unit and the slave unit is a patient shoulder or head support unit.

9. The system according to claim 1, wherein the controller allows for a change in the operative lengths of the first and second tensile support members in a direction which reduces tilt, and wherein the controller prevents any further change in the operative lengths of the first and second tensile support members in response to a tilt command requesting increase in tilt when the threshold difference is met or exceeded.

10. The system according to claim 1, wherein the controller only permits a change in the operative lengths of the first and second tensile support members which reduces the difference in operative lengths of the first and second tensile support members if the difference in operative lengths of the first and second tensile support members reaches or exceeds the threshold difference.

11. The system according to claim 1, wherein the control system allows synchronised up and down motion of the first and second tensile support members when the threshold difference has been reached.

12. The system according to claim 1, wherein the first and second motor units include a drum around which the associated tensile support member can be wound, the first and second motor units being rotary motors, the first and second position sensors being coupled to measure rotation of the associated rotary motor.

13. The system according to claim 1, wherein a differential change in the operative lengths of the first and second tensile support members provides for moving a patient from a reclining to a sitting position.

14. The system according to claim 1, wherein a differential change in the operative lengths of the first and second tensile support members is effected by a single one of the first and second motor units, and wherein the first and second motor units are separate devices.

15. The system according to claim 1, further comprising at least one limit switch associated with one of the first and second tensile support members, the limit switch determining a limit length of the associated tensile support member and a minimum operative length of the associated tensile support member.

16. The system according to claim 15, wherein the controller is coupled to the limit switch and is operative to determine a calibration position of the associated tensile support member.

17. The system according to claim 1, further comprising a limit switch associated with each of the first and second tensile support members.

18. A patient ceiling lift system comprising:

first and second tensile support members operatively associated with a winding assembly to adjust an operative length of the first and second tensile support members by extending or retracting the first and second tensile support members;

sling support apparatuses attachable to each of the first and second tensile support members, wherein the sling support apparatuses includes a coupler for securing a sling;

first and second sensors configured to provide an indication of a relative height of the sling support apparatuses with respect to one another; and a controller configured to determine and regulate a relative difference in height of the two sling support apparatuses, wherein the winding assembly comprises a first motor unit coupled to the first tensile support member and a second motor unit coupled to the second tensile support member, each of the first motor unit and the second motor unit being moveable along a rail, wherein the first and second sensors are coupled to a respective one of the first and second motor units, wherein one of the first and the second motor units is a master unit and the other is a slave unit, and wherein the master unit controls a patient leg support and the slave unit controls a patient head support, such that tilt is achieved by moving the patient's legs and not the patient's head.

19. The system according to claim 18, wherein the first and second sensors provide an indication of the relative height of the sling support apparatuses by determining a difference between the operative lengths of the first and second tensile support members and wherein the controller determines and regulates the relative difference in height of the sling support apparatuses by determining a difference between the operative lengths of the first and second tensile support members and adjusting at least one of the first and second tensile support members if the difference reaches or exceeds a threshold difference.

20. A patient ceiling lift system comprising:

first and second tensile support members operatively associated with a winding assembly to adjust an operative length of the first and second tensile support members by extending or retracting the first and second tensile support members, each tensile support member including a coupling for attachment to a patient sling;

first and second position sensors, each configured to provide an indication of the operative length of a respective one of the first and second tensile support members; and a controller configured to determine a difference between the operative lengths of the first and second tensile support members and to prevent any further increase in the difference if the difference reaches or exceeds a threshold difference, wherein the winding assembly comprises a first motor unit coupled to the first tensile support member and a second motor unit coupled to the second tensile support member, each of the first motor unit and the second motor unit being moveable along a rail, wherein the first and second position sensors are coupled to a respective one of the first and second motor units, wherein one of the first and the second motor units is a master unit and the other is a slave unit, wherein the user interface controller unit is connected to the master unit and includes an input tilt command providing for a change in the operative lengths of the first and second tensile support members relative to one another, allowing for a change in tilt of the patient sling supporting a patient, wherein the master unit adjusts the operative length of its associated tensile support member to produce said tilt, and the slave unit does not change the operative length of its associated tensile support member during a tilt command, and wherein the master unit controls a patient leg support and the slave unit controls a patient head support, such that tilt is achieved by moving the patient's legs and not the patient's head.

* * * * *